US007819607B2

(12) United States Patent
Carreras-Maldonado et al.

(10) Patent No.: US 7,819,607 B2
(45) Date of Patent: Oct. 26, 2010

(54) PAVING BLOCK AND MOLDING PROCESS THEREFOR

(76) Inventors: Efraín Carreras-Maldonado, P.O. Box 1052, Sabana Seca, Toa Baja, PR (US) 00952-1052; Javier E. Molinari, P.O. Box 1052, Sabana Seca, Toa Baja, PR (US) 00952-1052

( * ) Notice: Subject to any disclaimer, the term of this patent is extended or adjusted under 35 U.S.C. 154(b) by 440 days.

(21) Appl. No.: 11/377,534

(22) Filed: Mar. 17, 2006

(65) Prior Publication Data

US 2007/0216058 A1 Sep. 20, 2007

(51) Int. Cl.
*B28B 3/02* (2006.01)
*E01C 5/06* (2006.01)

(52) U.S. Cl. ..... 404/34; 404/35; 404/36; 404/41; 425/432; 249/139

(58) Field of Classification Search ..... 404/29–36, 404/41, 42, 72–73; 249/13, 207, 120, 139, 249/165; 425/432
See application file for complete search history.

(56) References Cited

U.S. PATENT DOCUMENTS 1,812,711 A 6/1931 Pessione
2,210,150 A * 8/1940 Notari ..... 404/38
2,919,634 A 1/1960 Plotner
3,694,128 A * 9/1972 Foxen ..... 425/412
3,870,422 A * 3/1975 Medico, Jr. ..... 404/31
3,940,229 A * 2/1976 Hutton ..... 425/436 R
4,093,690 A * 6/1978 Murray ..... 264/82
4,265,609 A * 5/1981 Kitahara ..... 425/260
4,326,817 A * 4/1982 Boiardi ..... 404/41
4,451,295 A * 5/1984 Sprouse ..... 106/715
4,545,754 A * 10/1985 Scheidt et al. ..... 425/419
4,627,764 A * 12/1986 Scheiwiller ..... 404/41
4,756,761 A * 7/1988 Philip et al. ..... 106/714
4,792,257 A * 12/1988 Rinninger ..... 404/41
4,907,909 A 3/1990 Ruckstuhl
4,915,539 A * 4/1990 Yoshikane et al. ..... 404/31
4,915,888 A * 4/1990 Sato ..... 264/71
4,973,192 A 11/1990 Hair
5,051,023 A * 9/1991 Yoshida et al. ..... 404/39
5,062,610 A * 11/1991 Woolford et al. ..... 249/52
5,115,602 A * 5/1992 de Larrard ..... 52/2.16
5,139,602 A * 8/1992 Suda et al. ..... 156/423
5,163,777 A 11/1992 Krueger
5,211,895 A * 5/1993 Jacklich, Sr. ..... 264/71
5,281,048 A * 1/1994 Hagenah ..... 404/44
5,487,526 A * 1/1996 Hupp ..... 249/2
5,797,238 A * 8/1998 Berntsson et al. ..... 52/612
5,887,846 A * 3/1999 Hupp ..... 249/2
D431,305 S * 9/2000 Barth et al. ..... D25/113

(Continued)

FOREIGN PATENT DOCUMENTS

JP 7-48186 * 2/1995

(Continued)

*Primary Examiner*—Raymond W Addie
(74) *Attorney, Agent, or Firm*—John J. Byrne

(57) ABSTRACT

A paving block that closely resembles a used mined cobblestone. The blocks are manufactured by a bi-layer concept that is subjected to processes that cause the layers to structurally integrate. The process and composition permit the mass production of blocks having independent top topographies that emulate the surfaces of original cobblestones and with a comparable strength.

10 Claims, 4 Drawing Sheets

U.S. PATENT DOCUMENTS

| | | | | | |
|---|---|---|---|---|---|
| D434,857 | S | * | 12/2000 | Scheiwiller | D25/113 |
| 6,159,401 | A | * | 12/2000 | Hoesch | 264/69 |
| 6,165,262 | A | | 12/2000 | Kono | |
| D442,703 | S | * | 5/2001 | Fifield | D25/113 |
| D464,147 | S | * | 10/2002 | Van Cauwenbergh | D25/113 |
| 6,461,552 | B1 | * | 10/2002 | Geiger | 264/71 |
| 6,627,315 | B2 | * | 9/2003 | Sakai | 428/406 |
| 6,790,544 | B2 | * | 9/2004 | Schmitz | 428/703 |
| 6,886,304 | B1 | * | 5/2005 | Godi et al. | 52/612 |
| 7,100,886 | B2 | * | 9/2006 | Hammer et al. | 249/104 |
| 7,204,470 | B2 | * | 4/2007 | Jurik | 249/74 |
| 7,396,495 | B2 | * | 7/2008 | Friesner | 264/46.4 |
| 2002/0109265 | A1 | * | 8/2002 | Braungardt et al. | 264/308 |
| 2005/0166518 | A1 | * | 8/2005 | Van Cauwenbergh | 52/596 |
| 2006/0056912 | A1 | * | 3/2006 | Altmann et al. | 404/38 |
| 2006/0237088 | A1 | * | 10/2006 | Morey et al. | 141/1 |
| 2006/0249881 | A1 | * | 11/2006 | Castonguay et al. | 264/297.9 |

FOREIGN PATENT DOCUMENTS

| | | | |
|---|---|---|---|
| WO | WO2006/084762 | A1 * | 8/2006 |

* cited by examiner

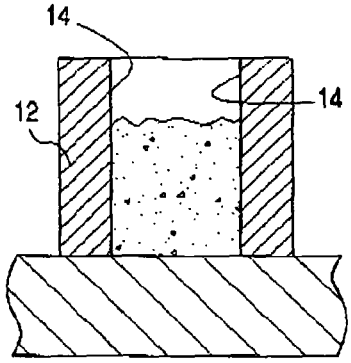
FIG. 7
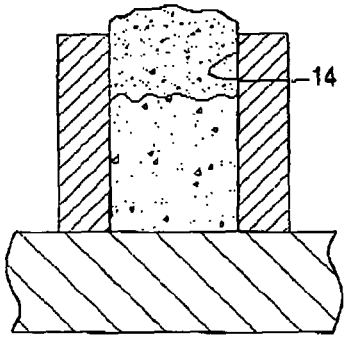
FIG. 8
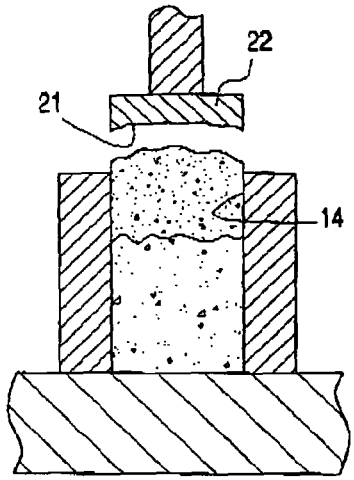
FIG. 9
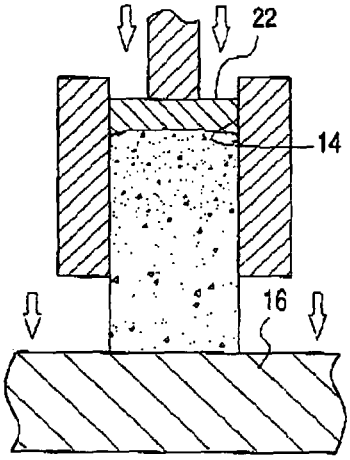
FIG. 10
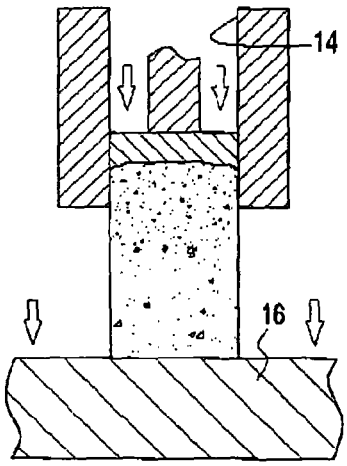
FIG. 11
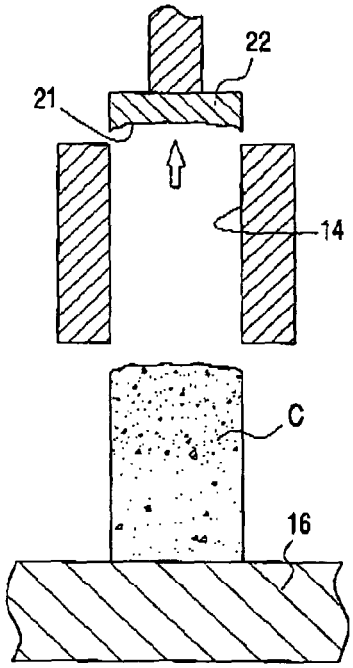
FIG. 12
FIG. 13
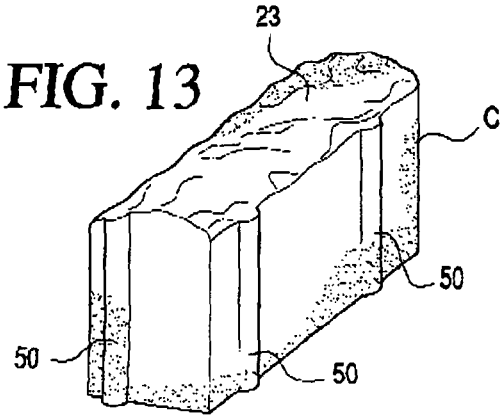
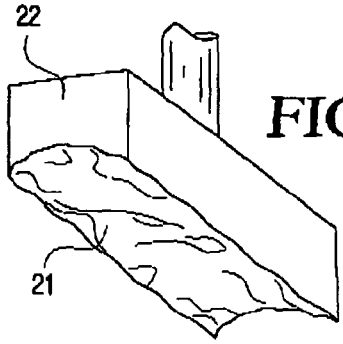
FIG. 14

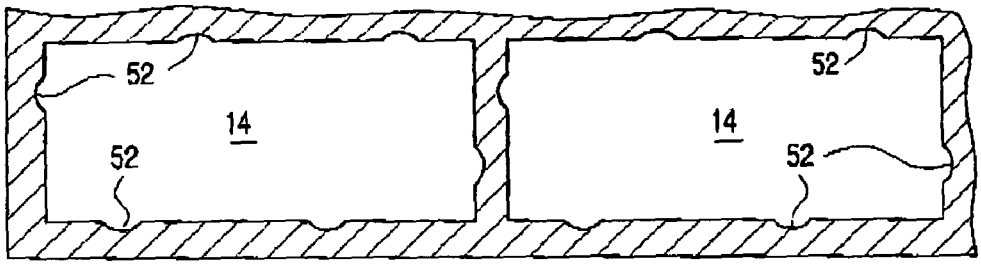
FIG. 15
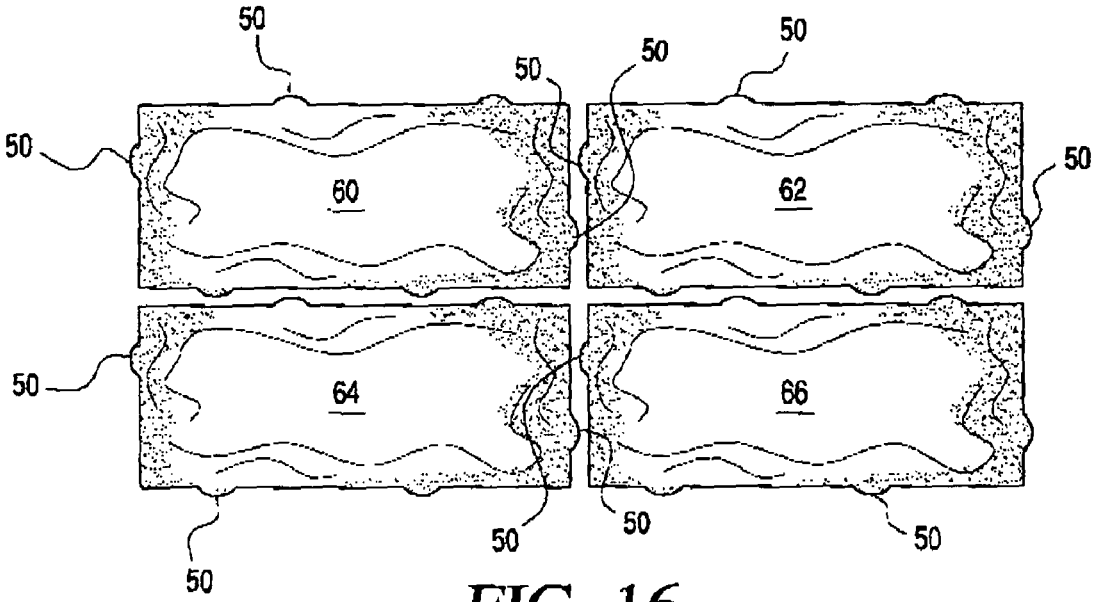
FIG. 16
FIG. 17
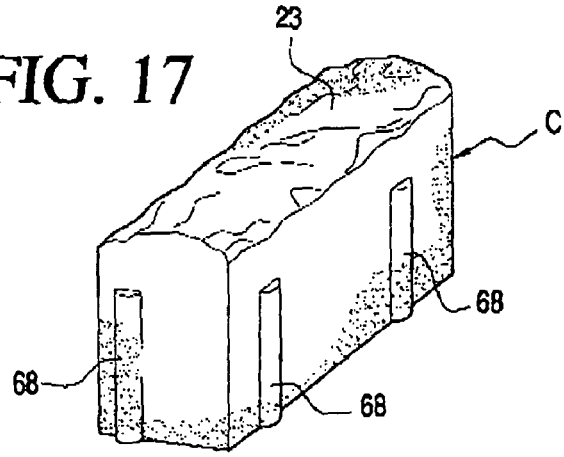

PAVING BLOCK AND MOLDING PROCESS THEREFOR

THE FIELD OF THE INVENTION

A paving block having cobblestone characteristics manufactured in a molding process with a layered composition of cement that gives the paving block a strength and appearance of an 17-18$^{th}$ century colonial cobblestones.

BACKGROUND OF THE INVENTION

For many centuries and before the advent of modern concrete technologies, many areas of the world, including in Colonial days of North and South America, streets, sidewalks, patios, and the like were often constructed of mined stone paving blocks. Because of their association with various historic periods and their attractiveness, mined cobblestones have become a desirable attribute to many communities. However, over time, many paving units must be replaced. Mined cobblestones are not economically feasible for replacement in many instances.

Workers in the prior art have developed certain methods and compositions for manufacturing paving blocks to replace cobblestones. However, none have developed the processes and product hereinafter described. The methods and compositions herein presented provide the art with a strong concrete base to satisfy demanding modern paving standards, and yet are produced economically with an appearance that closely emulates mined cobblestones.

SUMMARY OF THE INVENTION

The invention described hereinafter discloses a method of production that can be used to produce multiple paving blocks of substantial strength quickly and economically by utilizing a particular layered construction of materials that lends itself well to the production and manufacture of paving blocks.

One principal objective of this invention is to provide a paving block that emulates cobblestones of old by utilizing two layers of concrete that are intermingled through a vibration step.

Another important objective of this invention is to provide paving blocks with a cobblestone appearance that are formed within molds that have top surfaces that are replicas of actual cobblestones that have been exposed to weather and traffic for many years. The side and end surfaces are formed with vertical spacer nibs.

A further objective of the invention is to provide a paving block that has a substantial portion thereof utilizing Portland cement with a coarse aggregate to provide strength. This layer is topped with a second Portland cement composition utilizing fine aggregates with a variety of additives and colors that will give the appearance of stone cobblestones along the upper surfaces thereof in both color and topography.

A still further objective of the invention is to provide "dry cast" concrete compositions that are initially layered and then fused or intermingled through vibration techniques.

BRIEF DESCRIPTION OF DRAWINGS

A more complete appreciation of the invention, and many of its intended advantages will be readily obtained as the same become better understood by reference to the following description when considered in connection with the accompanied drawings, wherein:

FIG. 7 is a cross-section of a partially filled mold cavity;

FIG. 8 is a cross-section of a fully filled mold cavity;

FIG. 9 is a diagrammatic of a mold cavity with the top mold about to engage the concrete;

FIG. 10 is a view similar to FIG. 9 showing the initial stages of paving stone ejection;

FIG. 11 is a view similar to that of FIG. 10 with ejection almost complete;

FIG. 12 is a view similar to FIG. 10 after ejection is complete and the upper mold unit returning to its initial position;

FIG. 13 is a perspective view of a finished paving block that resembles a weathered cobblestone;

FIG. 14 is a perspective view of a bottom of an upper mold;

FIG. 15 is an enlarged top view of several mold cavities showing the nib intentions;

FIG. 16 is an enlarged top view of several paving blocks; and

FIG. 17 is a perspective view of a block having shortened nibs.

A DESCRIPTION OF THE PREFERRED EMBODIMENT

Figure 1:
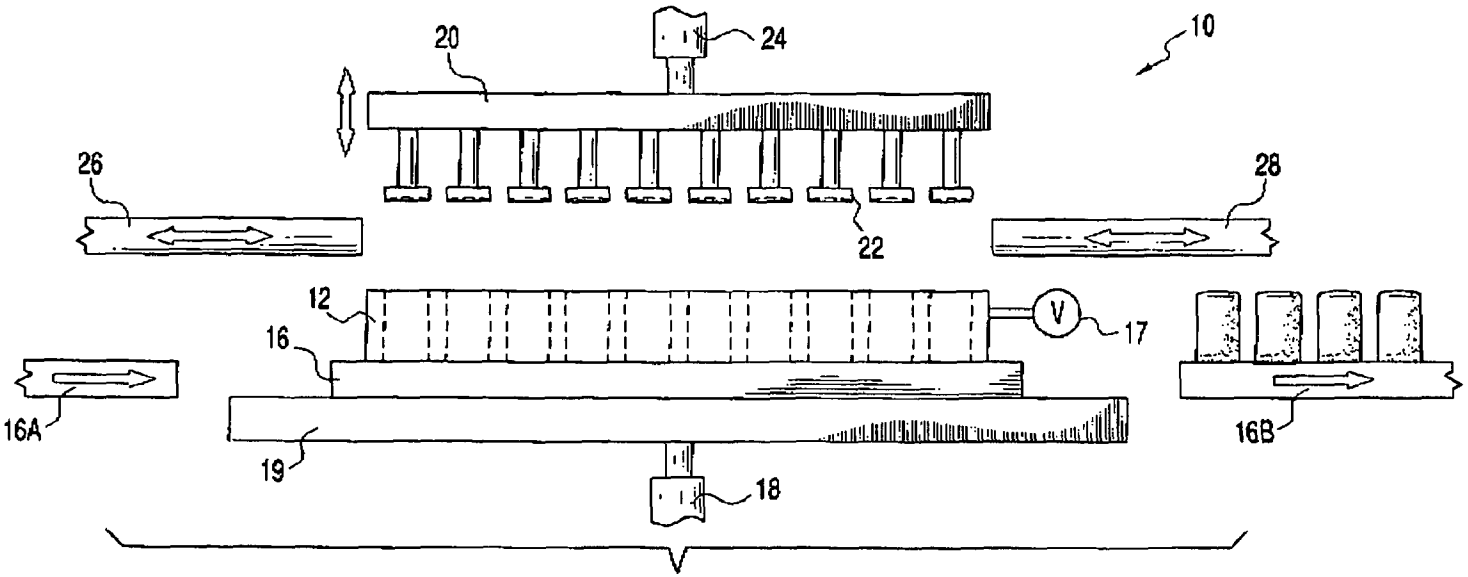
FIG. 1 is a diagrammatic side view showing the principle components of the invention.
Figure 3:
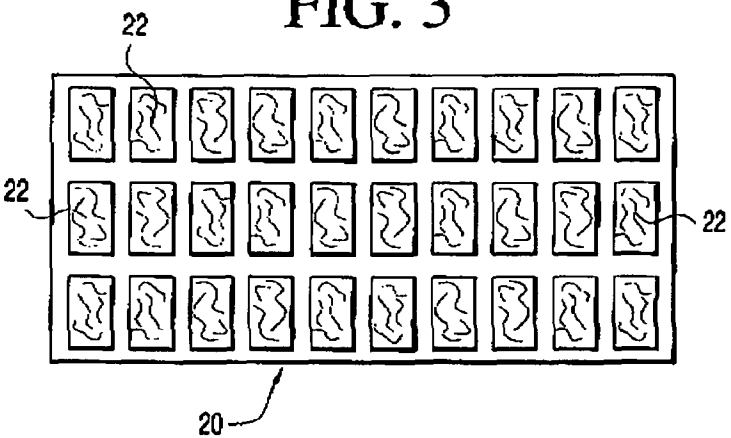
FIG. 3 is a bottom view of a mold/press units that provide the final topography of the top surfaces of the paving blocks produced.
Figure 2:
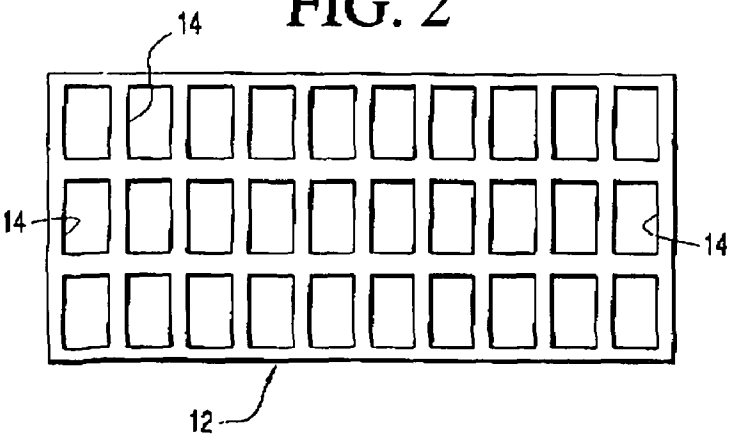
FIG. 2 is a plan view of a multiple mold unit.
Figure 4:
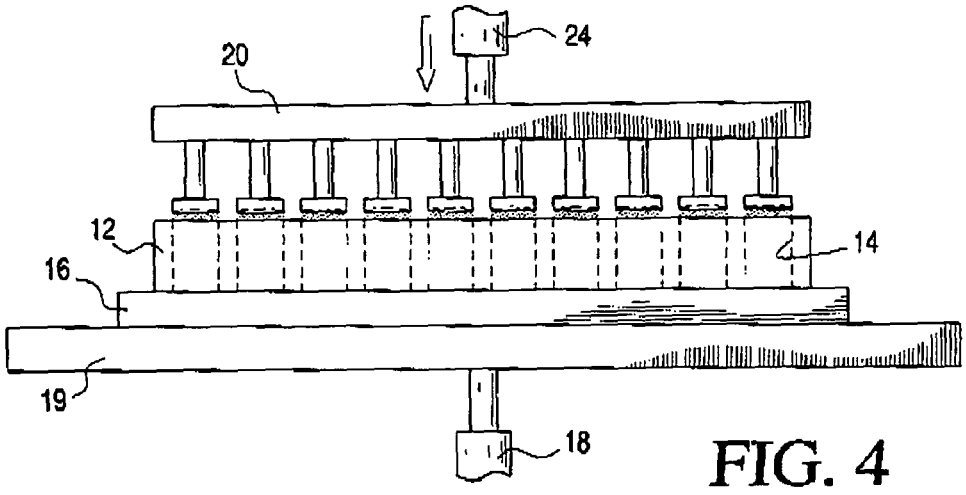
FIG. 4 discloses the apparatus of FIG. 1 after the mold cavities have been filled showing the upper molds in engagement with the concrete.
Figure 5:
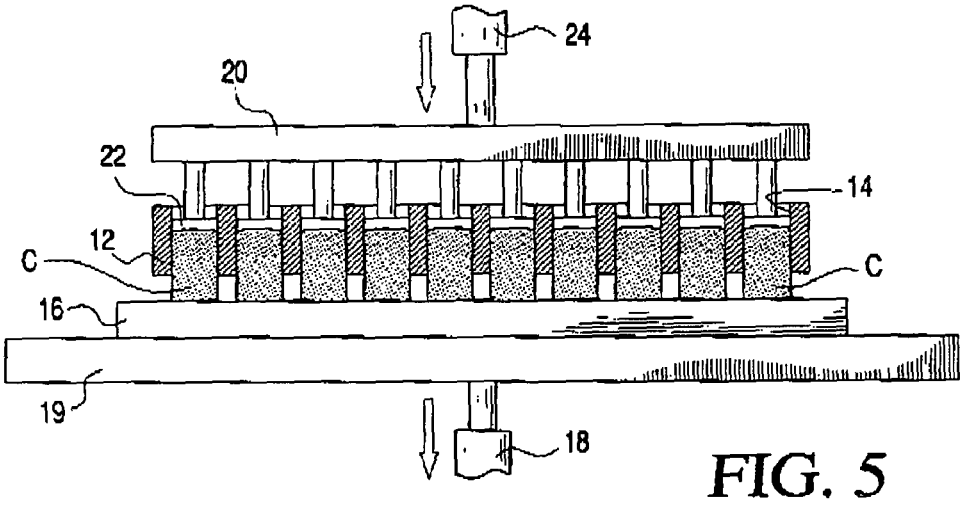
FIG. 5 disclosed the apparatus of FIG. 1 showing the upper molds moving downwardly against the formed cobblestones.
Figure 6:
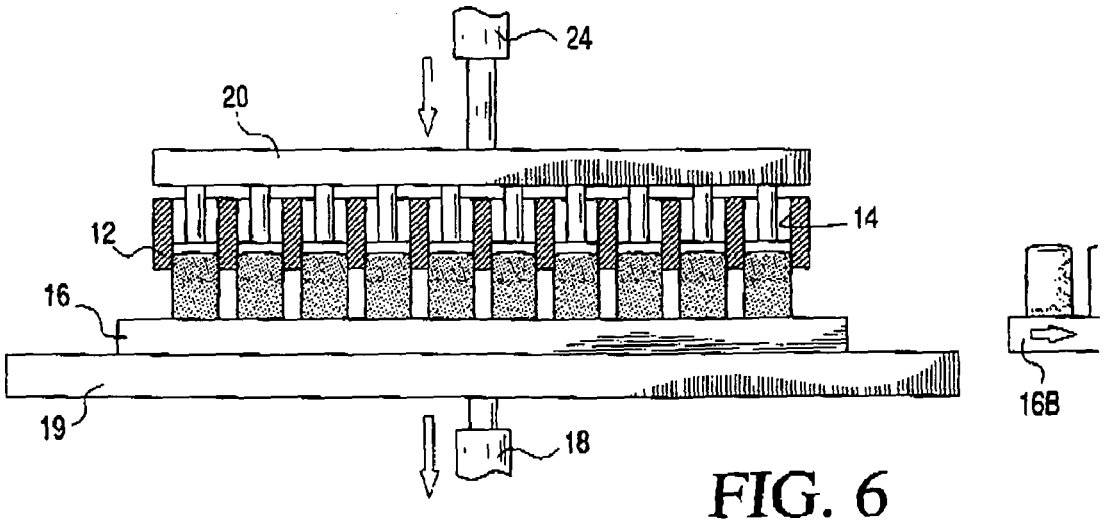
FIG. 6 discloses the apparatus as the cobblestones are deposited on a lowered pallet for removal.

Referring now to the drawings wherein like numerals indicated like parts, the numeral 10 refers to the major components represented in the diagrammatic presentation of FIG. 1. In this diagrammatic and in other views, it should be understood that certain conventional supporting structure and moving apparatus are not shown so that operation may be more readily understood.

A multi-unit steel mold 12 is supported at a selected height by conventional supporting structure. The mold 12 is rectangular and is formed with a plurality of mold cavities 14. The mold 12 is supported at the same height during all of the steps. The mold is connected to a vibrator 17 of conventional design. A pallet 16 is movable toward and away from mold 12 during a molding sequence. The pallet 16 closes the lower openings of the cavities 14 when it contacts the mold. The pallet is supported by a platform 19. In most models, the vibrator 17 also indicated by the letter V, is attached to the mold 12. A lifting apparatus 18 shown as a hydraulic cylinder moves the pallet 16 and platform 19 toward and away from the mold 12 during a molding sequence. Although apparatus 18 is shown as a hydraulic cylinder, it is representative of any lifting apparatus.

A top carrier 20 is disposed above mold 12 and supports a plurality of top shoes or molds 22, one each of which is disposed above and in-line with one each of the molding cavities 14. The perimeters of the top molds are slightly less than the perimeters of the interiors of their corresponding cavities 14. As will be seen, the top molds not only shape the upper surfaces of the cobblestones, but also are used to eject the formed cobblestones from the mold cavities. The hydraulic apparatus for moving the carrier 20 toward and away from the mold 12 is referred to by the numeral 24 but other moving apparatus can be used.

The mold cavities 14 are first filled with concrete from a first concrete drawer 26. Drawer 26 is moved over the mold unit 12 and deposits its concrete into the mold cavities 14. It fills them to approximately 80% capacity. The shoes 22 are then moved into cavities 14 and exert a compressing force on the concrete. The platform or mold is then vibrated for several seconds by vibrating unit V. After this first compacting and vibration step, the shoes 22 are raised, and a second concrete drawer 28 is moved into position over mold unit 12. The feed drawer 28 fills the molds to their capacity with a different concrete composition. The concrete mixtures delivered by each drawer are different in composition as will be described in more detail hereinafter.

The sequence for forming a plurality of paving blocks having a weathered cobblestone appearance includes the following steps:

1. The drawer 26 carries a first concrete mixture having a coarse aggregate over mold 12 and deposits the concrete into the mold cavities 14 until the mold cavities are filled to 70-80% capacity. During this step, the pallet 16 closes the lower openings of the mold.

2. After drawer 26 is withdrawn, the top shoes 22 are lowered into the partially filled cavities to compress this coarse mix while the mold 12 is vibrated.

3. After vibration stops, the shoes 22 are again retracted and drawer 28 is moved over the mold 12 to deliver a sufficient amount of a second concrete mixture to slightly over-fill the cavities 14.

4. Drawer 28 is withdrawn and carrier 20 is again lowered a sufficient amount for the shoes 22 to engage the top cement layer deposited by drawer 28 and with sufficient force to apply pressure against the concrete.

5. While top shoes 22 are in engagement with the concrete, the mold 12 is again vibrated for a sufficient time for the layered concrete mixtures to fuse.

6. After the second vibration step, the shoes 22 are lowered further to eject the finished paving blocks from their respective cavities 14. The platform 19 and pallet 16 are lowered as the plunger shoes 22 are lowered.

7. After the paving blocks are independent of their respective cavities, the shoes 22 are raised to their initial position.

8. The pallet 16 is removed from table 19 and replaced with a new pallet.

9. The new pallet 16 is then positioned on the platform and the pallet is raised to provide a bottom for the cavities 14. A new sequence begins.

The above process is operated using a "dry cast" method. Each layer of concrete is originally independent but the first layer becomes fused with the second layer during the second vibration step. The initial or bottom layer is made with Portland cement and coarse aggregates. A workable, suggested composition for the bottom layer includes the following:

| | |
|---|---|
| Portland Cement | 20-25% |
| Fly Ash | 0-5% |
| Coarse Aggregate | 65-75% |
| Water | 4-8% |

The term "coarse aggregate" refers to an aggregate such that a 5-mm sieve will pass from 80%-90% thereof Examples of the coarse aggregate are river gravel, mountain gravel, crushed stone, sea sand as well as natural lightweight aggregate, and artificial lightweight aggregates.

The top layer is made of a similar cement mix but with fine aggregates that include fly ash, specifically graded silica sand, chemical additives, and sufficient water to ensure proper curing. A workable suggested composition for the bottom layer includes the following:

| | |
|---|---|
| Portland Cement | 35-40% |
| Fine Aggregate | 35-40% |
| Chemical Additives | .05-.151% |
| Color Pigments | 0.2-0.5% |
| Water | 10-12% |
| Fly Ash | 10-20% |

The term "fine aggregate," mentioned above refers to an aggregate which wholly passes a 1 mm sieve and not less than 20% wt. of which passes a 0.15 mm sieve. Examples of the fine aggregate are mountain sand, sea sand, and crushed stone. These fine aggregates may be used either singly or in the form of a mixture of two or more components.

The amount of fly ash and coloring pigments can be varied somewhat to match the color tone for a particular installation. The chemical additives used are plasticizers. The purpose of said additives is to enhance the plasticity of the composition to increase the intermingling and fusion of the layers during the second vibration step.

Each layer is of a dry cast consistency. As stated, the second vibration process forms the two layers into a monolithic product of substantial strength and having the desired appearance. The cobblestone C are formed with spacer nibs 50 to provide spacing for sand and to provide some interlocking capabilities between each paving unit.

The top layer can be harder, darker, shinier and more luminous because its components include a variety of pigments, fly ash and refine aggregates that provide the desire visual and wearability characteristics.

As seen best in FIG. 14, the bottom surface 21 of each shoe 22 includes a topography similar to cobblestones of the type the product is intended to emulate. In order to obtain authenticity, the surfaces 21 have been developed by taking imprints of a wide variety of original historic cobblestones that have been weathered over a long period of time. Fissures, color variations, irregularities and smoothness from erosion and use are duplicated. An imprint is formed on each of the shoes 22 that track one of said duplicated cobblestone surfaces. Thus, the surfaces 21 of molds 22 can include a wide variety of imprints during each operational sequence so that a wide variety of topographies are produced in a single manufacturing sequence. This will provide installers with the ability to place side-by-side cobblestones having independent designs.

It should be understood that when the two layers are integrated through the vibration, the lower portion of the final product after installation is not visible to the eye. However, it is that lower portion of the paving block body that provides strength, load capacity and interlocking capability. The upper surface of the integrated top layer that is visible to the eye is intentionally irregular in shape, form, texture, color variation and is virtually indistinguishable from the original cobblestones that are emulated. This bi-layer concept allows for greater flexibility in adopting the needs of a particular location. The process steps are readily understood by reference to FIGS. 7-12, which show the relationship among the shoes, the pallet and the mold cavity during various steps of the process.

As stated above, the surface of top layer 21 that is visible to the eye is intentionally irregular in shape, form and texture, color-variegated (from a spectrographic analysis of the originals), so that there is a difference from paver to paver. After installation this provides pavers or paving blocks that are visually indistinguishable from the originals that have been weathered through hundreds of years. This bi-layer concept in the manufacturing process allows for wide flexibility in adapting to the needs of a particular location, a particular type of cobblestone, particular historical components or colors thereof, at sites that have undergone different historical weathering conditions.

It should be noted that platform 19 receives and discharges pallets 16 while in its lowest position. In FIGS. 10, 11 and 12 it can be seen that as the pallet/platform arrangement is lowered the shoes 22 are lowered an equal amount. Shoes 22 reach their lowest point at or near the bottom of cavities 14.

As mentioned above, the pavers are formed with spacer bars 50 along their sides and ends. Those protrusions, typically 1.5 to 2 mm in depth, are formed in the mold cavities 14. FIG. 15 is an enlarged top view of two mold cavities showing the intentions 52 that form the bars 50.

FIG. 16 shows a set of spacers 60 and 64 and a second set 62 and 66. Note that the end spacer bars of 60 and 62 are offset from one another and the side spacer bars of 60 and 64 are offset from one another, as are the side spacers of 61 and 66.

FIG. 17 is a view showing its spacer bars 68 stopping short of the top surface of its paver. These are often referred to as blind spacers. They cannot be seen after installation because the spacing between pavers is filled with sand. The spacing bars aid in the prevention of clipping and spalling.

In the embodiment disclosed, the cavities 14 and the mold shoes 22 have uniform peripheral dimensions. It should be understood that in a multi-cavity mold, the dimensions of all cavities 14 are not necessarily uniform. Multi-cavity forms can be made with a percentage of the cavities having different widths and lengths. This is desirable because "mined" cobblestones varied dimensionally. Of course, each shoe 22 must conform peripherally with its corresponding cavity.

The paver blocks are installed conventionally. This means a desirable spacing is established between pavers and the spacer are filled with sand or a like aggregate.

Conventional electrical circuitry, timers, micro-switchers and the like control the operational sequence. The first vibration step is set for approximately 4 to 6 seconds and the second vibration is set for approximately 6 to 9 seconds. The second vibration period not only causes the layers to fuse, but aids in causing the surface 21 to be faithfully reproduced on surface 23 of the paving blocks.

Thus the invention has been illustrated and described in the drawings and foregoing description, the same is to be considered as illustrative and not restrictive in character, it being understood that only the preferred embodiment has been shown and described and that all changes and modification that come within the spirit of the claims are to be protected.

The invention claimed is:

1. A paving block manufactured in a manner to emulate a weathered cobblestone comprising:

a relatively dry base layer consisting primarily of Portland cement and a coarse aggregate;

a relatively wet top layer consisting primarily of Portland cement and a fine aggregate;

said top layer having an upper outer surface and said top layer including sufficient fly ash and coloring agents to emulate the luminescence and coloring of a weathered cobblestone;

a weathered topographic impressed on said upper outer surface; and said base layer and said top layer are partially fused together.

2. A process of making a paving block comprising the steps of:

providing an open-ended cavity the size of the block to be made in a mold and said cavity having upper and bottom openings;

positioning a pallet to enclose said bottom opening;

partially filling said cavity with cement of a first relatively dry composition having a relatively high degree of a coarse aggregate while said pallet closes said lower opening;

vibrating said partially filled mold;

filling said mold cavity with a cement of a second relatively wet composition having a relatively high degree of a fine aggregate and that has an upper outer surface;

enclosing the upper end of said cavity with a molding surface that emulates a weathered look; and, applying pressure on said upper outer surface of said second composition by said molding surface.

3. The process of claim 2 wherein said mold is vibrated while said pressure is applied.

4. A process of simultaneously making a group of paving blocks comprising the steps of:

providing a plurality of mold units having open-ended cavities the size of the blocks to be made and said cavities having upper and lower openings;

positioning a pallet to enclose said lower openings;

partially filing said cavities with cement of a first relatively dry composition while said pallet closes said lower openings;

vibrating said mold of partially filled cavities;

filling said cavities with a cement of a second relatively wet composition having a greater percentage of a fine aggregate than said first composition;

enclosing the upper ends of said cavities with a plurality of molding surfaces emulating a weathered cobblestone for engaging said cement of said second composition;

applying pressure on said second composition by said molding surfaces.

5. A paving block manufactured in a manner to emulate a weathered cobblestone comprising:

a relatively dry base layer including approximately the following mixture:

| | |
|---|---|
| Portland Cement | 20-25% |
| Fly Ash | 0-5% |
| Coarse Aggregate | 65-75% |
| Water | 4-8% |

a top layer dispersed over said base layer and including approximately the following mixture:

| | |
|---|---|
| Portland Cement | 35-40% |
| Fine Aggregate | 35-40% |
| Chemical Fusion Additives | .05-.151% |
| Color Pigments | 0.2-0.5% |
| Water | 10-12% |
| Fly Ash | 10-20% |

said base layer and said top layer being partially fused together where they engage each other.

6. A process of making a paving block utilizing equipment that includes a multi-cavity mold having upper and lower openings, a vibrator to vibrate said mold, a first drawer to carry cement over said mold, a second drawer to carry cement over said mold, a pallet to close said lower opening of said mold and a second top mold member to close the upper opening of said mold and having a lower surface that emulates the contour of a weathered paver comprising the steps of:

enclosing the lower openings of said cavities by said pallet;

partially filling said mold cavities with a first dry cast cement composition having a relatively high percentage of coarse aggregate from said first drawer;

engaging said first composition with said second top mold member receivable by said cavity;

vibrating said mold;

disengaging said second top mold member from said composition;

filling said mold cavities with a second wet cast cement composition having a relatively high percentage of fine aggregate from said second drawer;

engaging said second composition with said lower surface;

vibrating said mold a second time to cause said first cement combination and said second cement combination to fuse; and ejecting said fused unit from said first mold.

7. The process of claim 6 wherein the cavities of said multi-cavity mold vary in peripheral dimensions and said second top mold members are provided that conform dimensionally with the cavities by which they are received.

8. A paving block manufactured in a manner to emulate a weathered cobblestone wherein said paving block is defined by first and second side surfaces, first and second end surfaces, a top upper outer surface and a bottom surface comprising:

a dry cast base layer consisting primarily of Portland cement and a coarse aggregate;

a wet cast top layer consisting primarily of Portland cement and a fine aggregate;

said top layer partially fused with said base layer;

a contour on said top upper outer surface emulating that of a weathered cobblestone;

said top layer including sufficient fly ash and coloring agents to emulate the luminescence and coloring of said weathered cobblestone; and spacer bars formed on said side surfaces and said end surfaces.

9. The paving block of claim 8 wherein said spacer bars extend from said bottom surface to mid-side surface.

10. The paving block of claim 8 wherein said spacer bars do not extend to said top surface.

* * * * *